US012760231B2

(12) United States Patent
Yamamoto et al.

(10) Patent No.: US 12,760,231 B2
(45) Date of Patent: Oct. 13, 2026

(54) APPARATUS AND METHOD FOR PRODUCING SYNTHETIC FUEL

(71) Applicant: HONDA MOTOR CO., LTD., Tokyo (JP)

(72) Inventors: Osami Yamamoto, Saitama-ken (JP); Chiharu Kaida, Saitama-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 193 days.

(21) Appl. No.: 18/675,203

(22) Filed: May 28, 2024

(65) Prior Publication Data

US 2024/0400919 A1 Dec. 5, 2024

(30) Foreign Application Priority Data

May 30, 2023 (JP) ..... 2023-088344

(51) Int. Cl.
*C10G 69/06* (2006.01)

(52) U.S. Cl.
CPC ..... *C10G 69/06* (2013.01); *C10G 2300/1022* (2013.01)

(58) Field of Classification Search
CPC ... C10G 69/06; C10G 2300/1022; C10G 2/32
See application file for complete search history.

(56) References Cited

U.S. PATENT DOCUMENTS 5,684,580 A * 11/1997 Cooper ..... G01N 21/65 356/301
2016/0046870 A1 2/2016 Murata et al.

FOREIGN PATENT DOCUMENTS

CA 2751615 A1 * 11/2011 ..... C10K 1/005
JP 2014-189603 A 10/2014

* cited by examiner

*Primary Examiner* — Prem C Singh
*Assistant Examiner* — Juan C Valencia
(74) *Attorney, Agent, or Firm* — Carter, DeLuca & Farrell LLP

(57) ABSTRACT

An apparatus for producing a synthetic fuel of the present invention includes a reactor that contains a catalyst exhibiting activity in a Fischer-Tropsch reaction and produces an FT crude oil containing hydrocarbons from a raw material gas; a fractionator that is provided on a downstream side of the reactor, fractionates the FT crude oil, and separates hydrocarbons having a predetermined range of carbon numbers; and a reformer that is provided on a downstream side of the fractionator and produces a fuel product from the hydrocarbons separated by the fractionator, in which the apparatus further includes an aromatic detection unit that is provided between the reactor and the fractionator and detects a concentration of aromatic hydrocarbons contained in the FT crude oil, and a fractionation temperature of the fractionator is changed according to the detected concentration of the aromatic hydrocarbons.

6 Claims, 6 Drawing Sheets

APPARATUS AND METHOD FOR PRODUCING SYNTHETIC FUEL

BACKGROUND

Technical Field

The present invention relates to an apparatus and method for producing a synthetic fuel by reforming a crude oil obtained from a raw material gas by a Fischer-Tropsch reaction.

Related Art

Recently, exhaust gas regulations of automobiles have been further advanced for the purpose of mitigating climate change or reducing the influence thereof, and as a part of this, research and development on effective use of carbon dioxide ($CO_2$) have been conducted. For example, a technique has been developed to synthesize hydrocarbons that can be used as fuels using carbon dioxide as a raw material by combining a reverse shift reaction in which carbon monoxide (CO) and water ($H_2O$) are produced by reacting carbon dioxide and hydrogen ($H_2$) with a Fischer-Tropsch synthesis reaction (hereinafter, referred to as "FT synthesis reaction") in which hydrocarbons (HCs) are synthesized from a synthesis gas of carbon monoxide and hydrogen using a catalytic reaction. In addition, in recent years, a direct FT synthesis reaction in which carbon dioxide and hydrogen are directly reacted to obtain hydrocarbons by performing a reverse shift reaction and an FT synthesis reaction in one reactor has also been studied.

In the FT synthesis reaction, in addition to hydrocarbons having about 5 to 10 carbon atoms as raw materials of gasoline and hydrocarbons having about 8 to 16 carbon atoms as raw materials of jet fuel (aviation turbine oil), heavy hydrocarbons having higher carbon numbers and light hydrocarbons including methane ($CH_4$) are produced. Therefore, a crude oil (hereinafter, referred to as "FT crude oil") having a wide hydrocarbon distribution produced by the FT synthesis reaction can be fractionated using a fractionation apparatus such as a distillation column, and then passed through a hydrogenation purification reactor to obtain a synthetic fuel product corresponding to the carbon number.

For example, JP 2014-189603 A discloses a technique for producing liquid fuels such as naphtha, kerosene, and light oil by fractionating various liquid hydrocarbon compounds produced in a reactor of an FT synthesis unit into each fraction in a rectifying column and performing reforming by a hydrogenation purification reactor provided for each fraction in an upgrading unit.

CITATION LIST

Patent Literature

Patent Literature 1: JP 2014-189603 A

SUMMARY

The carbon number distribution of the hydrocarbons produced by the FT synthesis reaction varies depending on the composition of the catalyst used. In addition, even in a case where the same catalyst is used, the reaction characteristics change depending on the number of times the catalyst is used and the length of elapsed reaction time, such that a constituent proportion of the produced hydrocarbons also changes, and as a result, a production amount of the synthetic fuel to be the final product can also greatly vary for each type.

In the technique described in JP 2014-189603 A, even in a case where fluctuations occur in hydrocarbon components due to deterioration of a catalyst or the like, a fractionation and reforming step for each fuel type in a step after the FT synthesis reaction is always regularly operated. Therefore, even in a case where a production amount of a fuel of a specific type is low, energy for operating a fractionator or a reformer for producing the fuel of the specific type is continuously consumed, and there is room for improvement in terms of production cost and efficiency.

An object of the present invention is to provide an apparatus and method for producing a synthetic fuel that can determine a type of a synthetic fuel suitable for production according to a state of production of hydrocarbons by an FT synthesis reaction and efficiently operate a fractionator at a fractionation temperature suitable for fractionation of hydrocarbons used for production of the synthetic fuel. In addition, another object of the present invention is to contribute to mitigating climate change or reducing the influence thereof.

According to an invention according to claim 1, an apparatus for producing a synthetic fuel includes a reactor 6 that contains an FT reaction catalyst exhibiting activity in a Fischer-Tropsch synthesis reaction (FT synthesis reaction) and produces an FT crude oil containing hydrocarbons from a raw material gas; a fractionator (a fractionator 9, a first fractionator 91, and a second fractionator 92 in embodiments (hereinafter, the same in the present section)) that is provided on a downstream side of the reactor 6, fractionates the FT crude oil, and separates hydrocarbons having a predetermined range of carbon numbers; and a reformer (a first reformer 10 and a second reformer 11) that is provided on a downstream side of the fractionator and produces a fuel product from the hydrocarbons separated by the fractionator, in which the apparatus further includes an aromatic detection unit (an aromatic detector 8) that is provided between the reactor 6 and the fractionator and detects a concentration CA of aromatic hydrocarbons contained in the FT crude oil, and a fractionation temperature Tfra of the fractionator is changed according to the detected concentration CA of the aromatic hydrocarbons.

As a result of intensive studies, the present inventors have found that a carbon number distribution of hydrocarbons produced by a predetermined FT synthesis reaction has a correlation with a concentration of aromatic hydrocarbons in the produced hydrocarbons. That is, there is a tendency that as a proportion of aromatic hydrocarbons in the produced hydrocarbons is higher, more hydrocarbons having lower carbon numbers are produced, and conversely, as the proportion of the aromatic hydrocarbons is lower, more hydrocarbons having higher carbon numbers are produced. Furthermore, it has been confirmed that in a certain type of catalyst, a relatively large amount of aromatic hydrocarbons is produced in a state where catalytic activity is high in the early stage of the reaction, and the production amount of aromatic hydrocarbons is relatively small in the late stage of the reaction or in a state where the catalyst is deteriorated and the activity is reduced. In other words, there was a tendency that when the catalytic activity was high, a large amount of hydrocarbons having low carbon numbers was produced, and when the catalytic activity was low, a large amount of hydrocarbons having high carbon numbers was produced.

Based on such findings, in the apparatus for producing a synthetic fuel of the present invention, the concentration of the aromatic hydrocarbons contained in the FT crude oil produced by the FT synthesis reaction is detected, and the fractionation temperature of the fractionator is changed according to the concentration of the aromatic hydrocarbons. As described above, since the carbon number distribution in the produced hydrocarbons can be estimated from the concentration of the aromatic hydrocarbons in the produced hydrocarbons, the type of the synthetic fuel suitable for production is determined based on the concentration, and the fractionation temperature is changed to a temperature suitable for fractionation of hydrocarbons used for production of the synthetic fuel, such that the fractionator can be efficiently operated and the synthetic fuel can be efficiently produced.

According to an invention according to claim 2, in the apparatus for producing a synthetic fuel according to claim 1, the fractionator is a temperature variable fractionator 9 capable of switching the fractionation temperature.

According to the configuration, since the fractionator is a temperature variable fractionator capable of switching the fractionation temperature, the fractionation temperature can be changed to a temperature at which a synthetic fuel can be efficiently produced according to the detected concentration of the aromatic hydrocarbons. Therefore, the fractionator can be efficiently operated while wasteful energy consumption is suppressed, and the synthetic fuel can be efficiently produced.

According to an invention according to claim 3, in the apparatus for producing a synthetic fuel according to claim 1, the fractionator is a plurality of fractionators (a first fractionator 91 and a second fractionator 92) each set to a different fractionation temperature, a branch pipe having a branch portion branching from the downstream side of the reactor 6 is connected to each of the plurality of fractionators, and the branch portion includes a switching valve 101 that switches a pipe that communicates with the reactor in the branch pipe based on the detected concentration CA of the aromatic hydrocarbons.

According to the configuration, a plurality of fractionators set at different fractionation temperatures are used as the fractionator, and the pipe that communicates with the reactor is switched by the switching valve according to the detected concentration of the aromatic hydrocarbons, such that the fractionator used is changed, and the temperature at which fractionation is performed is changed. As a result, fractionation can be performed at a fractionation temperature at which a synthetic fuel can be efficiently produced. Therefore, the fractionator can be efficiently operated while wasteful energy consumption is suppressed, and the synthetic fuel can be efficiently produced.

According to an invention according to claim 4, the apparatus for producing a synthetic fuel according to claim 1 further includes a heat exchange type gas-liquid separation device (gas-liquid separator 7) provided between the reactor 6 and the aromatic detection unit 8.

According to the configuration, since the heat exchange type gas-liquid separation device is provided between the reactor and the aromatic detection unit, it is possible to recover light hydrocarbons and unreacted gas mainly produced as gas together with the FT crude oil by the FT synthesis reaction and to separate them from the hydrocarbons that are used as raw materials of the synthetic fuel. In addition, the recovered light hydrocarbons and unreacted gas are returned to the upstream of the reactor and recycled, such that a yield of hydrocarbons usable as synthetic fuels can be improved.

According to an invention according to claim 5, the apparatus for producing a synthetic fuel according to any one of claims 1 to 4 further includes a notification unit (a notification unit 13) that notifies that a regeneration treatment or replacement of the FT reaction catalyst is required when the detected concentration CA of the aromatic hydrocarbons is below a predetermined threshold value CAref2.

According to the configuration, the detected aromatic hydrocarbon concentration is taken as an index indicating the progress of the deterioration of the FT reaction catalyst, and when the aromatic hydrocarbon concentration is below a predetermined threshold concentration, the notification unit notifies that it is time to perform a regeneration treatment or replacement of the FT reaction catalyst, and thus, the regeneration/replacement time of the FT reaction catalyst can be known using the aromatic detection unit.

According to an invention according to claim 6, a method for producing a synthetic fuel includes an FT crude oil production step of producing an FT crude oil containing hydrocarbons from a raw material gas using a reactor 6 containing an FT reaction catalyst exhibiting activity in a Fischer-Tropsch synthesis reaction (FT synthesis reaction); a fractionation step of fractionating the FT crude oil and separating hydrocarbons having a predetermined range of carbon numbers by a fractionator (a fractionator 9, a first fractionator 91, and a second fractionator 92) provided on a downstream side of the reactor 6; and a reforming step of producing a fuel product from the separated hydrocarbons by a reformer (a first reformer 10 and a second reformer 11) provided on a downstream side of the fractionator, in which the method further includes an aromatic detection step of detecting a concentration CA of aromatic hydrocarbons contained in the FT crude oil by an aromatic detection unit (aromatic detector 8) provided between the reactor 6 and the fractionator, and a fractionation temperature Tfra in the fractionation step is changed according to the detected concentration CA of the aromatic hydrocarbons.

In the method for producing a synthetic fuel of the present invention, the concentration of the aromatic hydrocarbons contained in the FT crude oil produced by the FT synthesis is detected, and the fractionation temperature of the fractionator is changed according to the concentration of the aromatic hydrocarbons. As described above, since the carbon number distribution in the produced hydrocarbons can be estimated from the concentration of the aromatic hydrocarbons in the produced hydrocarbons, the type of the synthetic fuel suitable for production is determined based on the concentration, and the fractionation temperature is changed to a temperature suitable for fractionation of hydrocarbons used for production of the synthetic fuel, such that the fractionator can be efficiently operated and the synthetic fuel can be efficiently produced.

DETAILED DESCRIPTION

Hereinafter, preferred embodiments of an apparatus for producing a synthetic fuel of the present invention will be described in detail with reference to the drawings. The configuration described below is an example of the present invention, and the present invention is not limited thereto. Note that, in the following description, the terms "upstream side" and "downstream side" refer to an upstream side and a downstream side in a fluid flow direction in each unit to be described.

Figure 1:
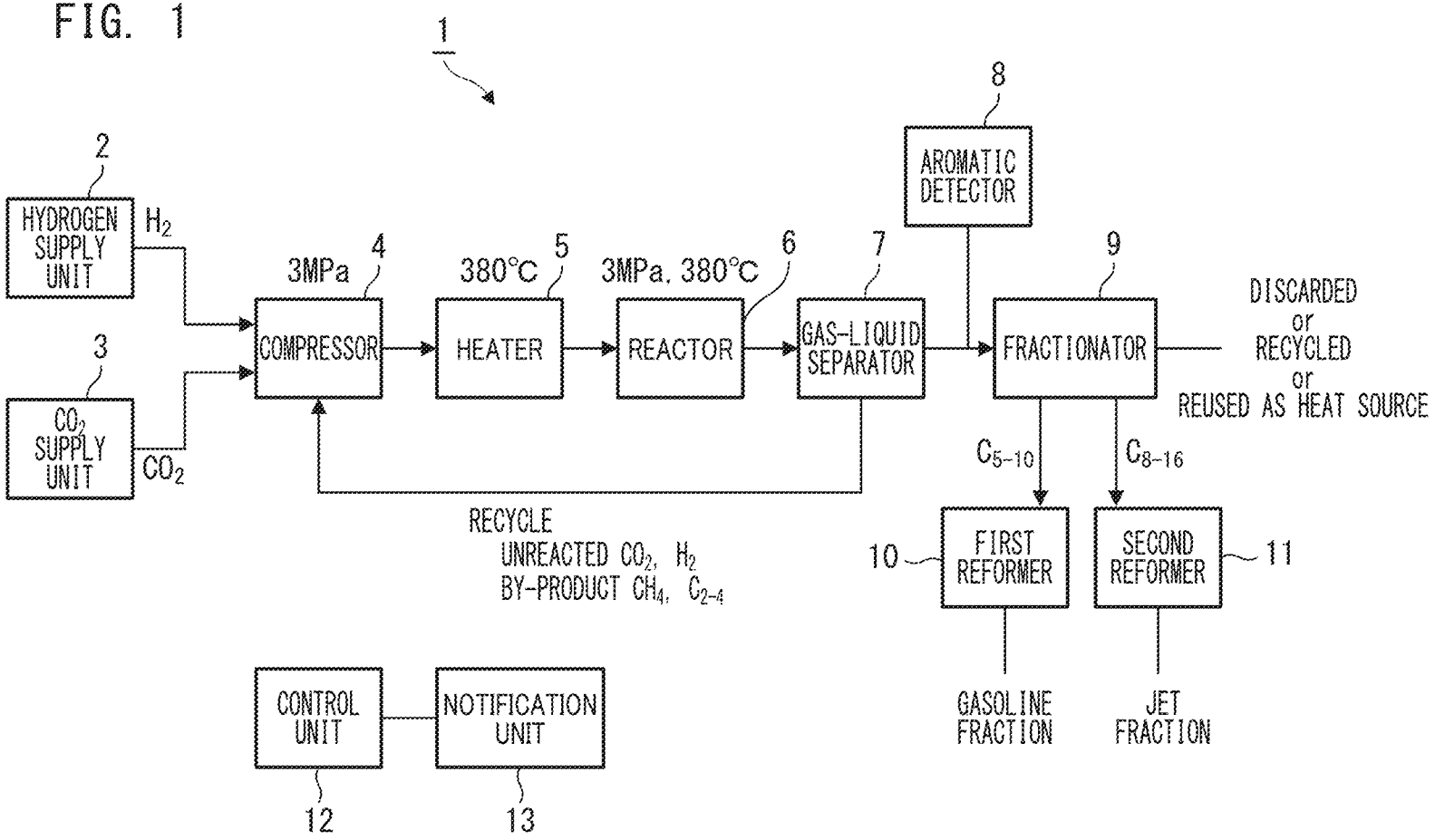
FIG. 1 is a diagram showing the overall structure of an apparatus for producing a synthetic fuel according to an embodiment of the present invention.

FIG. 1 illustrates a configuration example of the overall structure of an apparatus 1 for producing a synthetic fuel according to the present embodiment. The apparatus 1 for producing a synthetic fuel includes, in order from an upstream side, a hydrogen supply unit 2, a carbon dioxide supply unit 3, a compressor 4, a heater 5, a reactor 6, a gas-liquid separator 7, an aromatic detector 8, a fractionator 9, a first reformer 10, and a second reformer 11. Each unit of the apparatus 1 for producing a synthetic fuel is controlled by a control unit 12. With such a configuration, the apparatus 1 for producing a synthetic fuel produces an FT crude oil by an FT synthesis reaction using carbon dioxide gas and hydrogen gas as raw material gases, determines which one of gasoline and jet fuel is produced according to the carbon numbers of hydrocarbons contained in the produced FT crude oil, performs fractionation at a fractionation temperature suitable for the determination, and then undergoes a hydrogenation purification step by a reformer to produce gasoline or jet fuel.

The hydrogen supply unit 2 and the carbon dioxide supply unit 3 supply hydrogen gas and carbon dioxide gas to a pipe connected to the compressor 4, respectively. Supply amounts of the hydrogen gas and the carbon dioxide gas are detected by a flow rate sensor (not illustrated) or the like, and the detected values are transmitted to the control unit 12. The control unit 12 controls the supply amounts so that hydrogen and carbon dioxide have a predetermined ratio suitable for the FT synthesis reaction. In the present embodiment, for example, the supply amounts are controlled so that a molar ratio $H_2/CO_2$ is 3. In addition, although not illustrated, an inert gas supply unit of nitrogen, argon, helium, or the like is separately connected to the pipe on the upstream side of the apparatus 1 for producing a synthetic fuel for a purge process at the termination of the FT synthesis reaction, and is configured to be appropriately switchable with the raw material gas for the FT reaction.

As described below, the compressor 4 and the heater 5 are provided for creating a high-pressure and high-temperature state suitable for performing the FT synthesis reaction in the present embodiment. The type of the compressor 4 is not particularly limited as long as the compressor 4 can compress the raw material gas obtained by mixing the supplied hydrogen gas and carbon dioxide gas and send the compressed raw material gas to the heater 5 on the downstream side. For example, a centrifugal turbocompressor, an electric pump, or the like driven by an electric motor can be used. A pressure sensor (not illustrated) is provided on the downstream side of the compressor 4, and a detected value thereof is transmitted to the control unit 12. The compressor 4 of the present embodiment is controlled by the control unit 12 so as to increase the pressure of the raw material gas to about 3 MPaG. In addition, the heater 5 may be any heater as long as it can raise the temperature of the compressed raw material gas and send the raw material gas to the reactor 6 on the downstream side. A temperature sensor (not illustrated) is provided on the downstream side of the heater, and a detected value thereof is transmitted to the control unit 12. The heater 5 of the present embodiment is controlled by the control unit 12 so as to raise the temperature of the raw material gas to about 380° C.

The reactor 6 contains a catalyst (hereinafter, referred to as "FT reaction catalyst") exhibiting activity in the FT synthesis reaction therein, and produces an FT crude oil containing hydrocarbons from the raw material gas passing through the reactor 6 by the FT synthesis reaction. The reaction performed in the reactor 6 of the present embodiment is a direct FT synthesis reaction represented by the following Formula (1) in which carbon dioxide and hydrogen are directly reacted to produce hydrocarbons and water.

$$nCO_2 + mH_2 \longrightarrow HC + H_2O \tag{1}$$

As the FT reaction catalyst of the present embodiment, a combination of a pellet-like sodium iron catalyst obtained by adding sodium (Na) as a co-catalyst to iron (Fe), gallium (Ga), and zirconium (Zr), which are catalytic metals, and a zeolite catalyst using aluminosilicate zeolite (ZSM-5) at a predetermined proportion is used.

The FT crude oil produced by the direct FT synthesis reaction using the FT reaction catalyst contains hydrocarbons having about 5 to 10 carbon atoms as raw materials of gasoline, hydrocarbons having about 8 to 16 carbon atoms as raw materials of jet fuel (aviation turbine oil), and heavier hydrocarbons having higher carbon numbers. In addition, light hydrocarbons ($C_{2-4}$) having 2 to 4 carbon atoms including methane ($CH_4$) are produced as gas.

The gas-liquid separator 7 is a heat-exchange type gas-liquid separation device, and separates a gas-liquid two-phase product composed of an FT crude oil, light hydrocarbons, unreacted gas, and the like that exits the reactor 6 and flows into the gas-liquid separator 7 into a liquid-phase FT crude oil, gas-phase light hydrocarbons ($C_{2-4}$) including methane, and unreacted gas ($CO_2$ and $H_2$). The separated liquid-phase FT crude oil is sent to the fractionator 9 on the downstream side. On the other hand, the gas-phase light hydrocarbons and the unreacted gas are returned to the compressor 4 on the upstream side, mixed with the raw material gas, and recycled.

The aromatic detector 8 is an apparatus capable of detecting the concentration CA of the aromatic hydrocarbons in the hydrocarbons in the FT crude oil sent from the gas-liquid separator 7 to the fractionator 9, and for example, a commercially available gas chromatography apparatus can be used. The detected value of the aromatic hydrocarbon concentration CA is transmitted to the control unit 12 and used for a fractionation temperature switching process to be described below.

The fractionator 9 separates hydrocarbons having a predetermined range of carbon atoms from the FT crude oil containing hydrocarbons having 5 or more carbon atoms using a difference in boiling point. In particular, the fractionator 9 in the present embodiment is a temperature variable fractionator capable of switching and setting the fractionation temperature Tfra. The fractionator 9 is provided with a temperature sensor such as a thermocouple (not illustrated), and the detected value thereof is sent to the control unit 12. The control unit 12 controls an output of a heat source unit (not illustrated) so that the detected value of the temperature sensor approaches the set fractionation temperature Tfra. Note that a control unit for the fractionator 9 different from the control unit 12 may be separately provided to control the fractionation temperature Tfra.

In the fractionator 9 of the present embodiment, the fractionation temperature Tfra is configured to be switchable between a first fractionation temperature Tfra1 for separating hydrocarbons having 5 to 10 carbon atoms capable of producing gasoline and a second fractionation temperature Tfra2 for separating hydrocarbons having 8 to 16 carbon atoms capable of producing jet fuel.

The first fractionation temperature Tfra1 is set to, for example, a temperature (for example, around 180° C.) at which hydrocarbons having 10 or fewer carbon atoms are vaporized. When the fractionation temperature Tfra of the fractionator 9 is set to the first fractionation temperature Tfra1, the gas component separated by the fractionator 9 is cooled by a cooler (not illustrated) or the like and then sent to the first reformer 10 on the downstream side in a liquid state, and the remaining liquid component is discarded or recycled after being cracked.

The second fractionation temperature Tfra2 is set to, for example, a temperature (for example, around 100° C.) at which hydrocarbons having 7 or fewer carbon atoms are vaporized. When the fractionation temperature Tfra of the fractionator 9 is set to the second fractionation temperature Tfra2, the gas component separated by the fractionator 9 is discarded or reused as a heat source, and the remaining liquid component is sent to the second reformer 11 on the downstream side.

The first reformer 10 performs a hydrogenation treatment on the liquid hydrocarbons mainly having 5 to 10 carbon atoms supplied from the fractionator 9 by using the hydrogen gas supplied from hydrogen supply unit 2, and then performs purification by distillation to take out gasoline as a synthetic fuel product.

The second reformer 11 performs a hydrogenation treatment on the liquid hydrocarbons mainly having 8 to 16 carbon atoms supplied from the fractionator 9 by using the hydrogen gas supplied from hydrogen supply unit 2, and then performs purification by distillation to take out jet fuel as a synthetic fuel product.

The control unit 12 is an electronic control unit (ECU) that controls each unit of the apparatus 1 for producing a synthetic fuel, and includes a microcomputer including a CPU, a RAM, a ROM, an I/O interface (all not illustrated), and the like. The control unit 12 in the present embodiment controls at least operations of the hydrogen supply unit 2, the carbon dioxide supply unit 3, the compressor 4, the heater 5, the aromatic detector 8, and the fractionator 9. In addition, the fractionation temperature in the fractionator 9 is controlled particularly by executing a fractionation temperature switching process to be described below.

As described below, when the concentration CA of the aromatic hydrocarbons detected by the aromatic detector 8 is below a predetermined threshold value CAref2, a notification unit 13 notifies that a regeneration treatment or replacement of the catalyst should be performed. The notification may be in any form, and for example, an arbitrary form such as displaying an icon on a control panel (not illustrated) of the apparatus 1 for producing a synthetic fuel, turning on an indicator, or performing voice guidance can be selected.

Next, the fractionation temperature switching process in the present embodiment will be described. As described above, in the present embodiment, the direct FT synthesis reaction is performed using a catalyst obtained by mixing a sodium iron catalyst and a zeolite catalyst. In the case using such a catalyst, deterioration of the zeolite catalyst easily occurs as compared with the sodium iron catalyst due to factors such as caulking of pores of zeolite caused by carbon generated by the FT synthesis reaction, and structural destruction caused by promotion of dealumination (Al) of zeolite by water ($H_2O$) generated by the FT synthesis reaction. It is confirmed that the carbon number distribution of the hydrocarbons produced by the direct FT synthesis reaction changes depending on a degree of deterioration of the zeolite catalyst.

Figure 2:
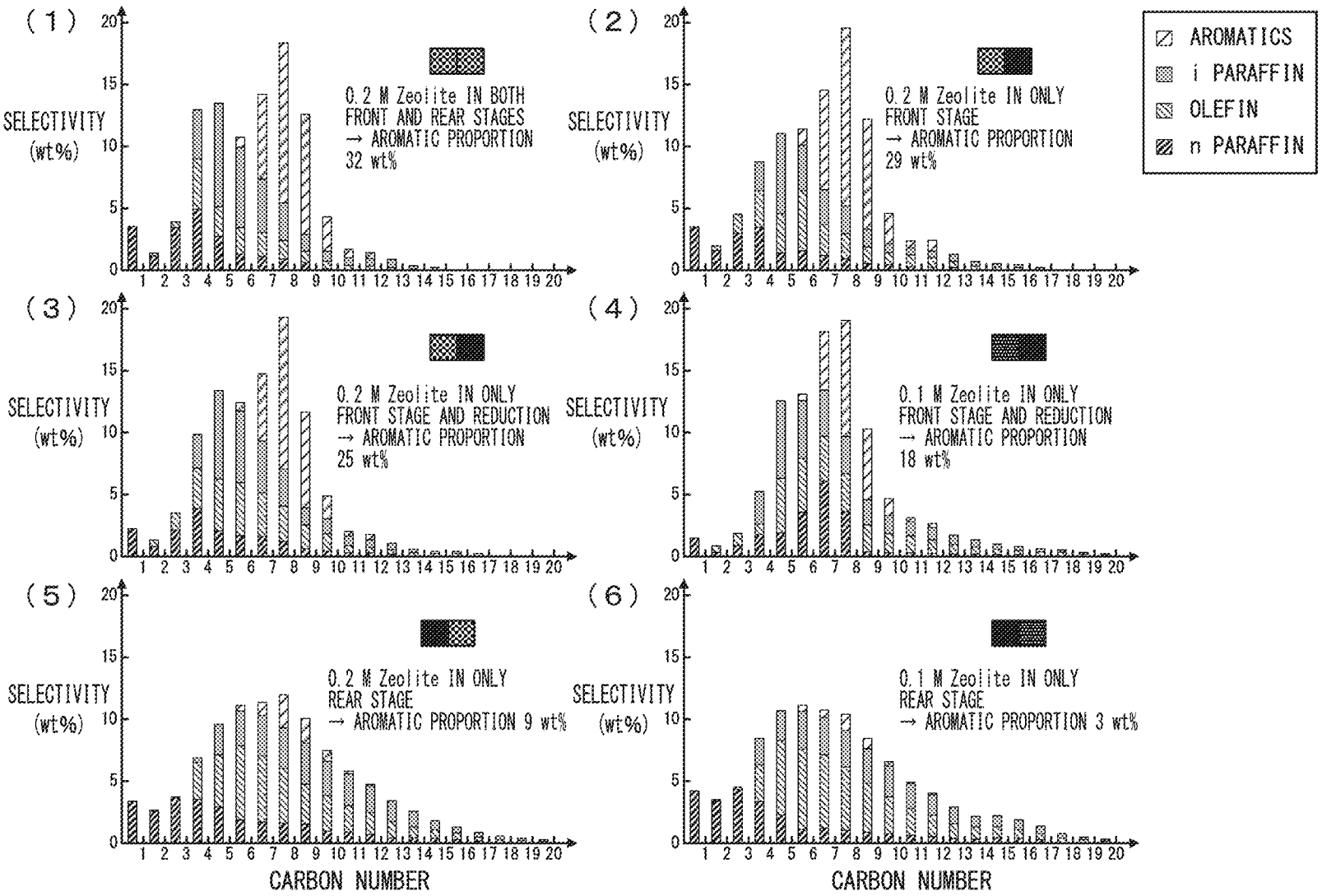
FIG. 2 is a graph showing a relationship between a carbon number of a produced hydrocarbon and a selectivity of a hydrocarbon compound depending on a difference in composition of an FT reaction catalyst.

FIG. 2 is a graph showing a relationship between a carbon number of a produced hydrocarbon and a selectivity of a hydrocarbon compound depending on a difference in composition of an FT reaction catalyst in the present embodiment. In (1) to (6) of FIG. 2, in order to simulate a gradually progressing deterioration state of the zeolite catalyst in the FT reaction catalyst, the FT synthesis reaction was performed while changing the amount, quality, and arrangement of the zeolite catalyst mixed with the sodium iron catalyst. (1) of FIG. 2 simulates a state in which the activity of the zeolite catalyst is the highest, and simulates a state in which the deterioration of the zeolite catalyst gradually progresses from (2) to (6). Note that, here, a two-stage catalyst divided into a front stage and a rear stage was employed as the FT reaction catalyst.

In (1) of FIG. 2, a mixture of a sodium iron catalyst and a zeolite catalyst was used in both the front and rear stages, and zeolite surface-treated with sodium hydroxide having a molar concentration of 0.2 mol/L was used as the zeolite catalyst.

In (2) of FIG. 2, a mixture of a sodium iron catalyst and a zeolite catalyst was used in only the front stage, and zeolite surface-treated with sodium hydroxide having a molar concentration of 0.2 mol/L was used as the zeolite catalyst. For the rear stage, only a sodium iron catalyst was used.

In (3) of FIG. 2, a mixture of a sodium iron catalyst and a zeolite catalyst was used only in the front stage, and a mixing amount of the zeolite catalyst was reduced as compared with (2) of FIG. 2. As the zeolite catalyst, zeolite surface-treated with sodium hydroxide having a molar concentration of 0.2 mol/L was used. For the rear stage, only a sodium iron catalyst was used.

In (4) of FIG. 2, a mixture of a sodium iron catalyst and a zeolite catalyst was used only in the front stage, and a mixing amount of the zeolite catalyst was reduced as compared with (2) of FIG. 2. As the zeolite catalyst, zeolite surface-treated with sodium hydroxide having a molar concentration of 0.1 mol/L was used. For the rear stage, only a sodium iron catalyst was used.

In (5) of FIG. 2, a mixture of a sodium iron catalyst and a zeolite catalyst was used in only the rear stage, and zeolite surface-treated with sodium hydroxide having a molar concentration of 0.2 mol/L was used as the zeolite catalyst. For the front stage, only a sodium iron catalyst was used.

In (6) of FIG. 2, a mixture of a sodium iron catalyst and a zeolite catalyst was used in only the rear stage, and zeolite surface-treated with sodium hydroxide having a molar concentration of 0.1 mol/L was used as the zeolite catalyst. For the front stage, only a sodium iron catalyst was used.

As illustrated in FIG. 2, from (1) to (6), the carbon number distribution of the hydrocarbons produced by the FT synthesis reaction changes as the activity of the zeolite catalyst decreases, and it can be seen that as the activity increases, a larger number of hydrocarbons having low carbon numbers are produced, and as the activity decreases, a larger number of hydrocarbons having high carbon numbers are produced.

In addition, with regard to the selectivity of the hydrocarbon compound in the produced hydrocarbons, in (1) where the activity of the zeolite catalyst is the highest, a production proportion of aromatic hydrocarbons (aromatics) is 32 wt %, which is the highest, and in (6) where the activity of the zeolite catalyst is the lowest, a production proportion of aromatic hydrocarbons (aromatics) is 3 wt %, which is the lowest. Note that the proportion of the aromatic hydrocarbons was calculated from components having 5 or more carbon atoms. The reason why the higher the activity of the zeolite catalyst, the higher the production proportion of aromatic hydrocarbons is considered to be because a cyclization reaction proceeds by a cracking and dehydrogenation reaction of higher hydrocarbons by zeolite and an oligomerization and dehydrogenation reaction of lower hydrocarbons.

Figure 3:
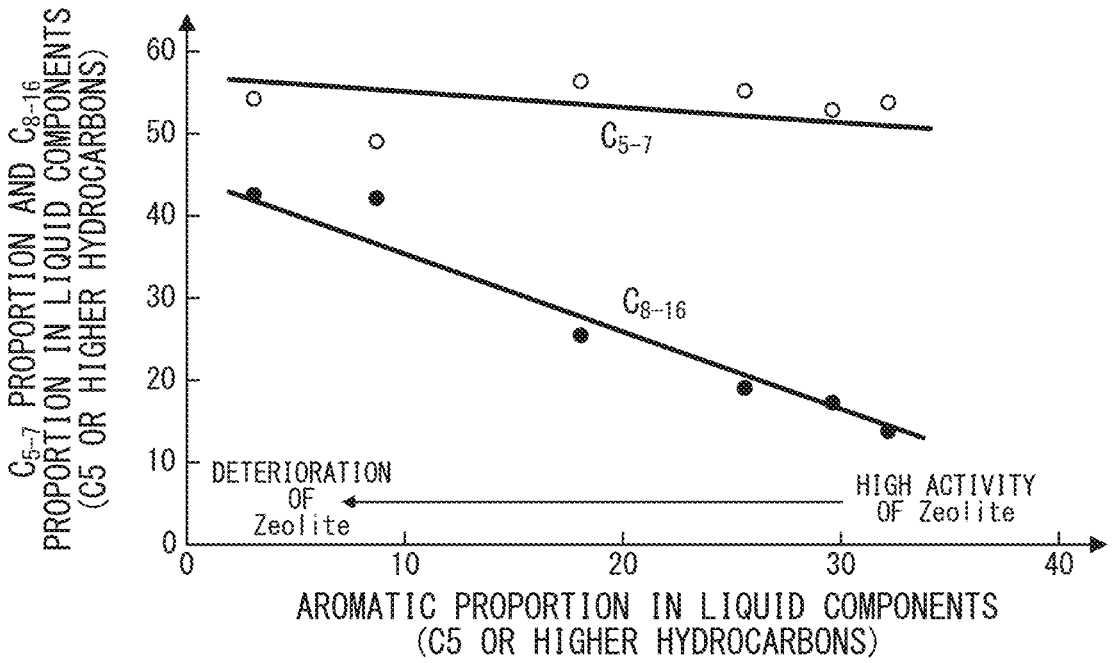
FIG. 3 is a graph showing a relationship between a proportion of aromatics in liquid components (hydrocarbons having 5 or more carbon atoms) of hydrocarbons produced by an FT synthesis reaction, and a proportion of hydrocarbons having 5 to 7 carbon atoms and a proportion of hydrocarbons having 8 to 16 carbon atoms.

FIG. 3 is a graph showing a relationship between a proportion of aromatics in liquid components (that is, an FT crude oil containing hydrocarbons having 5 or more carbon atoms) of hydrocarbons produced by an FT synthesis reaction, and a proportion of hydrocarbons having 5 to 7 carbon atoms and a proportion of hydrocarbons having 8 to 16 carbon atoms, the relationship being calculated based on (1) to (6) of FIG. 2. As illustrated in FIG. 3, it can be seen that the lower the proportion of aromatic hydrocarbons in the FT crude oil (that is, as the deterioration of the zeolite catalyst progresses), the higher the production proportion of hydrocarbons having 8 to 16 carbon atoms suitable for production of jet fuel.

Therefore, when the aromatic concentration in the FT crude oil is high (that is, when the activity of the zeolite catalyst is high), it is considered efficient to produce gasoline by separating hydrocarbons having carbon numbers (about 5 to 10 carbon atoms) suitable for the production of the gasoline, and when the aromatic concentration in the FT crude oil is low (that is, when the activity of the zeolite catalyst is low), it is considered efficient to produce jet fuel by separating hydrocarbons having carbon numbers (about 8 to 16 carbon atoms) suitable for the production of the jet fuel.

Figure 4:
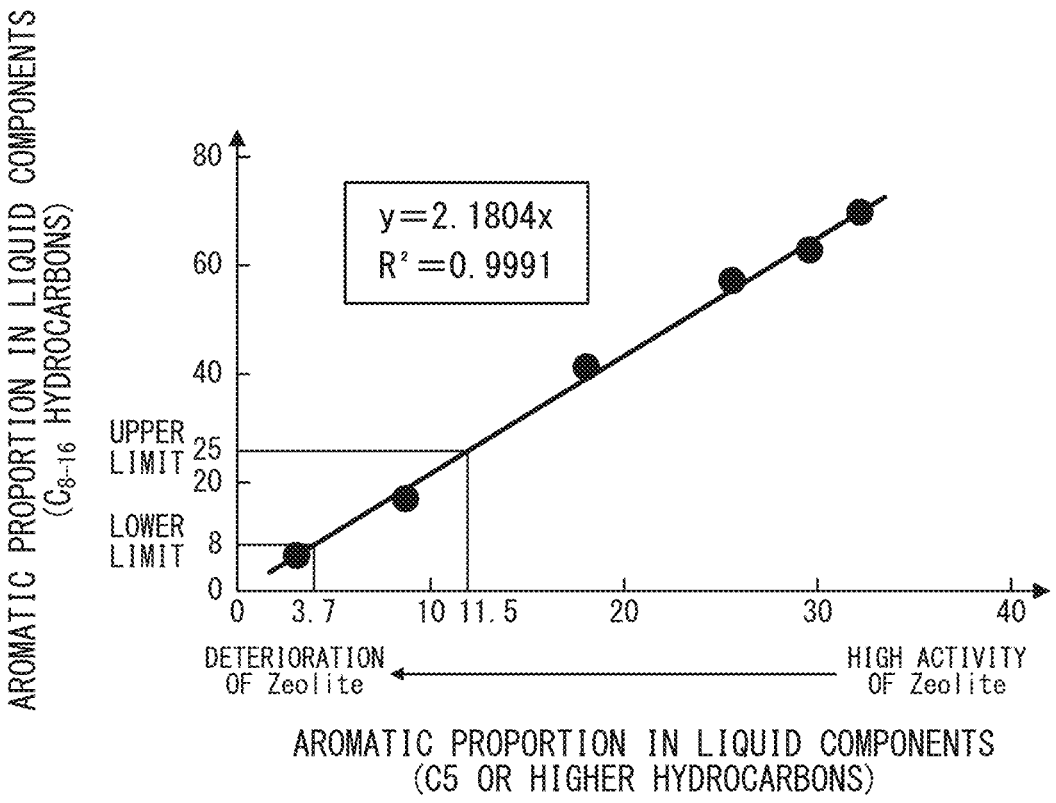
FIG. 4 is a graph showing a relationship between a proportion of aromatics in hydrocarbons having 5 or more carbon atoms and a proportion of aromatics in hydrocarbons having 8 to 16 carbon atoms among the hydrocarbons produced by the FT synthesis reaction.

FIG. 4 is a graph showing a relationship between a proportion of aromatic hydrocarbons in the FT crude oil and a proportion of aromatic hydrocarbons in hydrocarbons having 8 to 16, the relationship being calculated based on (1) to (6) of FIG. 2. The slope of the regression line was 2.1804, and the coefficient of determination $R^2$ was a significantly high numerical value of 0.9991. Therefore, the aromatic hydrocarbon concentration CA in the FT crude oil is measured, such that it is possible to estimate the concentration of the aromatic hydrocarbons in the hydrocarbons having 8 to 16 carbon atoms used for the production of the jet fuel with high accuracy.

At present, components of bio-jet fuel are required to conform to ASTM D7566 which is an international standard. According to the standard, it is required that an aromatic component is contained in an amount of 8 wt % or more and 25 wt % or less in hydrocarbons having 8 to 16 carbon atoms used for jet fuel. When the numerical values are converted into the aromatic proportion in the FT crude oil using the graph of FIG. 4, the numerical values are 3.7 wt % or more and 11.5 wt % or less as shown in the graph.

Note that, at present, the aromatic component of the jet fuel on the market is about 20 wt %. When the numerical value is converted into the aromatic proportion in the FT crude oil using the graph of FIG. 4, a numerical value of 9.2 wt % is obtained. Therefore, it can be said that it is most preferable for the production of jet fuel that the aromatic proportion in the FT crude oil is in a range of about 9.2±1 wt %.

Based on these experimental data, it is found that it is efficient to acquire hydrocarbons having carbon numbers suitable for production of gasoline while the concentration CA of the aromatic hydrocarbons in the FT crude oil produced by the FT synthesis reaction exceeds 11.5 wt %, and to acquire hydrocarbons having carbon numbers suitable for production of jet fuel from the time point when the concentration CA of the aromatic hydrocarbons in the FT crude oil becomes 11.5 wt % or less. In addition, when the concentration CA of the aromatic hydrocarbons in the FT crude oil is less than 3.7 wt %, it can be determined that a regeneration treatment or replacement of the zeolite catalyst is required because the jet fuel conforming to ASTM D7566 cannot be produced.

Figure 5:
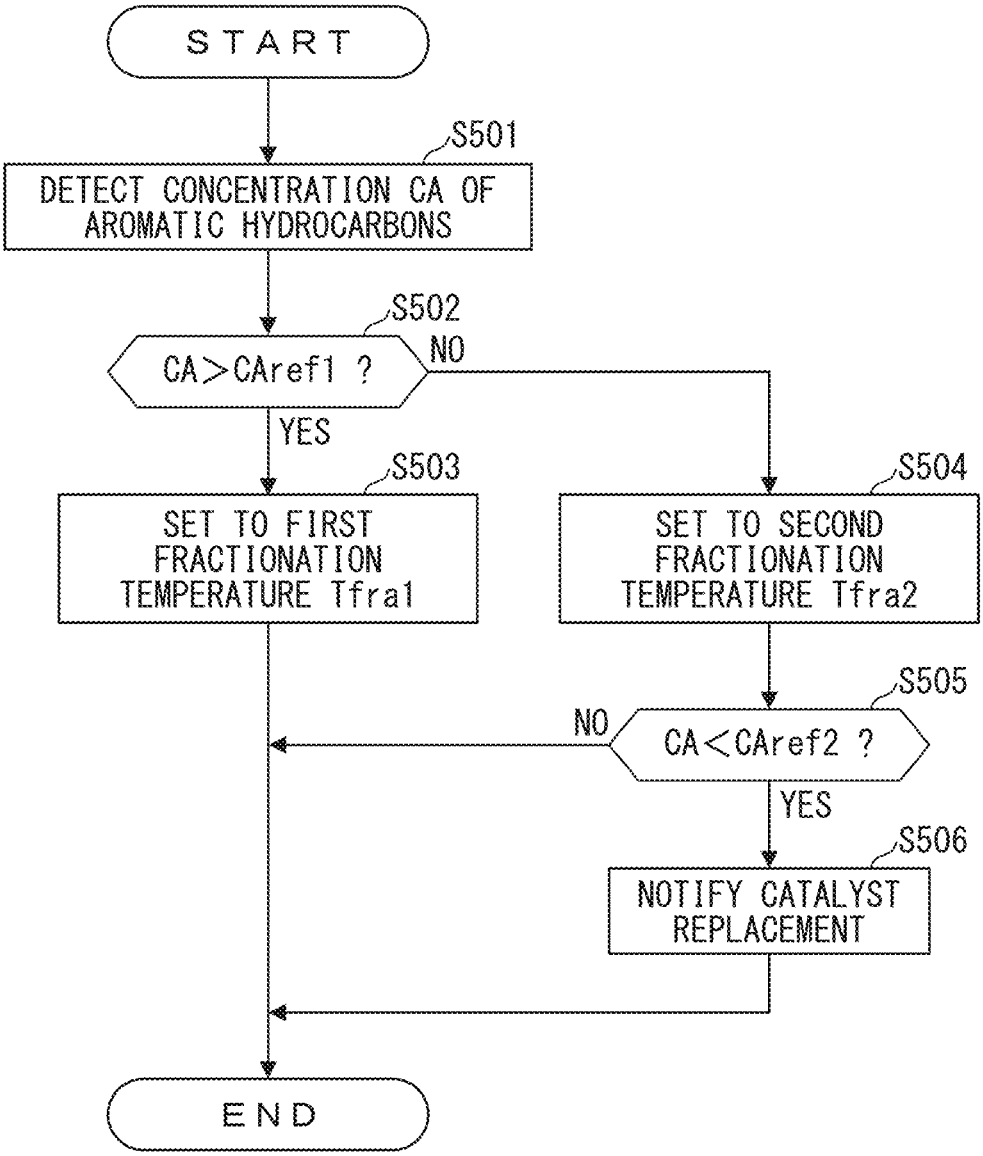
FIG. 5 is a flowchart showing a fractionation temperature switching process.

In the apparatus 1 for producing a synthetic fuel of the present embodiment, a fractionation temperature switching process for switching the fractionation temperature Tfra in the fractionator 9 is executed based on such findings. FIG. 5 is a flowchart showing the fractionation temperature switching process in the present embodiment. The process shown in the flowchart is executed by a processor included in the control unit 12 releasing a program stored in a storage device such as a ROM to a memory such as a RAM. The present process is repeatedly executed, for example, at predetermined time intervals during a normal operation of the apparatus 1 for producing a synthetic fuel.

First, in step 501 (shown as "S501" in the drawing, the same applies hereinafter), the concentration CA of the aromatic hydrocarbons in the FT crude oil produced by the FT synthesis reaction is detected by the aromatic detector 8. Next, in step 502, it is determined whether the detected aromatic concentration CA exceeds a predetermined first threshold concentration Caref1.

The first threshold concentration Caref1 is set as an aromatic concentration suitable for switching a type of a synthetic fuel to be produced from gasoline to jet fuel based on the hydrocarbon distribution when the aromatic hydrocarbons in the FT crude oil are at the corresponding concentration and the aromatic component concentration in the jet fuel determined by ASTM D7566. In the present embodiment, the first threshold concentration Caref1 is set within a range of 11.5±1 wt % based on the experimental data described above. Note that it is most preferable that the first threshold concentration CAref1 is set to 11.5 wt %.

When the determination result in step 502 is YES and the aromatic concentration CA detected from the FT crude oil exceeds the first threshold concentration CAref1, it is determined that the hydrocarbon distribution and the aromatic concentration CA in the FT crude oil are suitable for production of gasoline, and the process proceeds to step 503.

In step 503, the fractionation temperature Tfra of the fractionator 9 is set to a first fractionation temperature Tfra1 for separating hydrocarbons having 5 to 10 carbon atoms capable of producing gasoline, and the process ends.

On the other hand, when the determination result in step 502 is NO and the aromatic concentration CA detected from the FT crude oil is equal to or less than the first threshold concentration CAref1, it is determined that the hydrocarbon distribution and the aromatic concentration CA in the FT crude oil are suitable for production of jet fuel, and the process proceeds to step 504. In step 504, the fractionation temperature Tfra of the fractionator 9 is set to a second fractionation temperature Tfra2 for separating hydrocarbons having 8 to 16 carbon atoms capable of producing jet fuel, and the process proceeds to step 505.

In step 505, it is determined whether the detected aromatic concentration CA is below a predetermined second threshold concentration CAref2. The second threshold concentration CAref2 is set as an aromatic concentration at which a concentration of the aromatic components in the produced jet fuel is below a minimum aromatic component concentration in the jet fuel determined by ASTM D7566 when the concentration of the aromatic hydrocarbons in the FT crude oil is below the corresponding concentration. In the present embodiment, the second threshold concentration CAref2 is set within a range of 3.7±1 wt % based on the experimental data described above. Note that it is most preferable that the second threshold concentration CAref2 is set to 3.7 wt %.

When the determination result in step 505 is NO and the aromatic concentration CA detected from the FT crude oil is equal to or higher than the second threshold concentration CAref2, it is determined that the aromatic concentration in the produced jet fuel is within the range required by ASTM D7566, and the process ends.

On the other hand, when the determination result in step 505 is YES and the aromatic concentration CA detected from the FT crude oil is below the second threshold concentration CAref2, it is determined that the aromatic concentration in the produced jet fuel does not meet the requirements of ASTM D7566, the notification unit 13 notifies that the zeolite catalyst needs to be regenerated or replaced, and the process ends.

As described above, according to the apparatus 1 for producing a synthetic fuel of the present embodiment, the concentration CA of the aromatic hydrocarbons contained in the FT crude oil produced by the FT synthesis reaction is detected, and the fractionation temperature Tfra of the fractionator 9 is changed according to the concentration CA. With the configuration, the type of the synthetic fuel suitable for production is determined based on the concentration CA of the aromatic hydrocarbons, and the fractionation temperature Tfra is changed to a temperature suitable for fractionation of hydrocarbons used for production of the synthetic fuel, such that the fractionator can be efficiently operated and the synthetic fuel can be efficiently produced.

In particular, since the fractionator 9 is a temperature variable fractionator capable of switching the fractionation temperature, the fractionation temperature Tfra can be changed to a temperature at which a synthetic fuel can be efficiently produced according to the detected concentration CA of the aromatic hydrocarbons. As a result, the fractionator can be efficiently operated while wasteful energy consumption is suppressed, and the synthetic fuel can be efficiently produced.

In addition, since the gas-liquid separator 7 is provided between the reactor 6 and the aromatic detector 8, it is possible to recover light hydrocarbons and unreacted gas mainly produced as gas together with the FT crude oil by the FT synthesis reaction and to separate them from the FT crude oil. In addition, the recovered light hydrocarbons and unreacted gas are returned to the upstream of the reactor 6 and recycled, such that a yield of hydrocarbons usable as synthetic fuels can be improved.

Further, the detected aromatic hydrocarbon concentration CA is taken as an index indicating the progress of the deterioration of the zeolite catalyst, and when the concentration CA is below the second threshold concentration CAref2, the necessity of the regeneration treatment or replacement of the FT reaction catalyst is notified, such that the regeneration/replacement time of the zeolite catalyst can be known using the aromatic detector 7.

Figure 6:
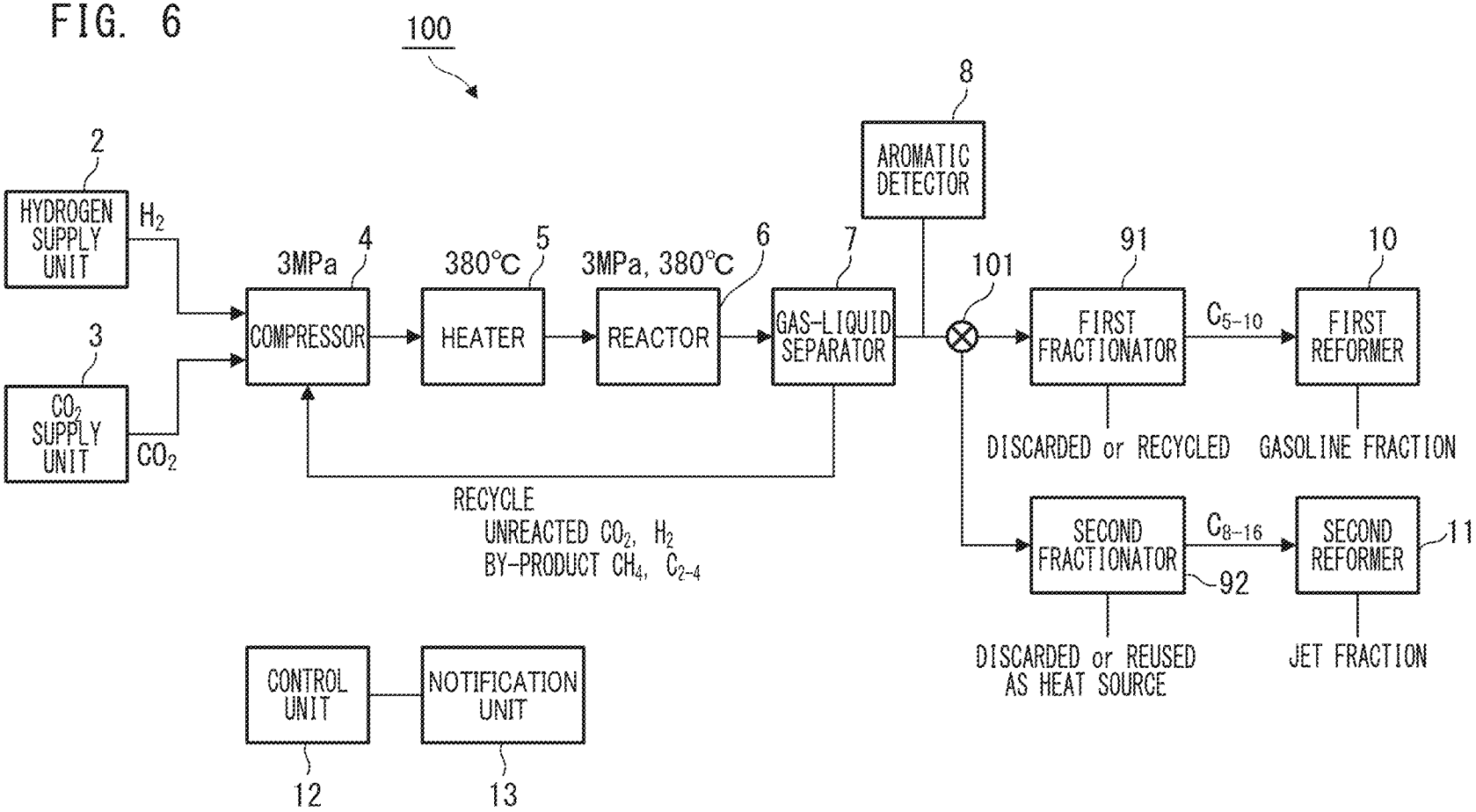
FIG. 6 is a diagram showing the overall structure of an apparatus for producing a synthetic fuel according to another embodiment.

Next, an apparatus 100 for producing a synthetic fuel according to a second embodiment of the present invention will be described with reference to FIG. 6. Note that, in the following description of the embodiment, the same components as those described in the above embodiment are denoted by the same reference numerals, and the description thereof will be omitted.

In the apparatus 1 for producing a synthetic fuel according to the embodiment described above, the temperature variable fractionator 9 capable of switching and setting the plurality of fractionation temperatures Tfra1 and Tfra2 is adopted as the configuration for changing the fractionation temperature Tfra by the fractionator according to the detected concentration CA of the aromatic hydrocarbons. On the other hand, in the apparatus 100 for producing a synthetic fuel according to the second embodiment, a plurality of fractionators 91 and 92 set to different fractionation temperatures Tfra1 and Tfra2 are adopted instead of the fractionator 9.

In the first fractionator 91, the fractionation temperature Tfra is set to the above-described first fractionation temperature Tfra1 suitable for production of gasoline, a gas component containing hydrocarbons mainly having 5 to 10 carbon atoms separated by the first fractionator 91 is cooled by a cooler (not illustrated) or the like and then sent to a first reformer 10 on the downstream side in a liquid state, and the remaining liquid component is discarded or recycled after being cracked.

On the other hand, in the second fractionator 92, the fractionation temperature Tfra is set to the above-described second fractionation temperature Tfra2 suitable for production of jet fuel, a gas component containing hydrocarbons mainly having 5 to 7 carbon atoms separated by the second fractionator 92 is discarded or reused as a heat source, and the remaining liquid component is sent to a second reformer 11 on the downstream side.

Each of the plurality of fractionators 91 and 92 is connected to a branch pipe having a branch portion branching from the downstream side of a gas-liquid separator 7, and a switching valve 101 is provided at the branch portion. The switching valve 101 is configured to be switchable so that only one of the branch pipe connected to the first fractionator 91 and the branch pipe connected to the second fractionator 92 selectively communicates with the gas-liquid separator 7.

The operation of the flow path switching of the switching valve 101 is controlled by a control unit 12. A fractionation temperature switching process in the apparatus 100 for producing a synthetic fuel is substantially similar to the control described in FIG. 5, but only the processes in step 503 and step 504 are different. That is, when the determination result in step 502 is YES and the aromatic concentration CA detected from the FT crude oil exceeds the first threshold concentration CAref1, in the following step, a process of switching the switching valve 101 to the first fractionator 91 is performed. On the other hand, when the determination result in step 502 is NO and the aromatic concentration CA detected from the FT crude oil is below the first threshold concentration CAref1, in the following step, a process of switching the switching valve 101 to the second fractionator 92 is performed.

As described above, according to an apparatus 100 for producing a synthetic fuel, the plurality of fractionators 91 and 92 each set to different fractionation temperatures Tfra1 and Tfra2 are used, and the pipe that communicates with the gas-liquid separator 7 or the reactor 6 on the upstream side is switched by the switching valve 101 according to the detected concentration CA of the aromatic hydrocarbons, such that the fractionator used is changed and the fractionation temperature changes. As a result, fractionation can be performed at a fractionation temperature at which a synthetic fuel can be efficiently produced. Therefore, the fractionator can be efficiently operated while wasteful energy consumption is suppressed, and the synthetic fuel can be efficiently produced.

Note that the present invention is not limited to the described embodiments, and can be implemented in various modes. In addition, the detailed configuration can be changed appropriately within the scope of the gist of the present invention.

What is claimed is:

1. An apparatus for producing a synthetic fuel, the apparatus comprising:

a reactor configured to contain an FT reaction catalyst exhibiting activity in a Fischer-Tropsch synthesis reaction (FT synthesis reaction) and produce an FT crude oil containing hydrocarbons from a raw material gas;

a fractionator provided on a downstream side of the reactor, configured to fractionate the FT crude oil, and separate hydrocarbons having a predetermined range of carbon numbers; and a reformer provided on a downstream side of the fractionator and configured to produce a fuel product from the hydrocarbons separated by the fractionator, wherein the apparatus further includes an aromatic detection unit that is provided between the reactor and the fractionator and detects a concentration of aromatic hydrocarbons contained in the FT crude oil, and wherein a control unit of the apparatus is configured to change a fractionation temperature of the fractionator to a temperature suitable for the FT synthesis reaction of hydrocarbons with a predetermined number of carbon atoms that is mainly to be obtained according to the detected concentration of the aromatic hydrocarbons.

2. The apparatus for producing a synthetic fuel according to claim 1, wherein the fractionator is a temperature variable fractionator capable of switching the fractionation temperature.

3. The apparatus for producing a synthetic fuel according to claim 1, wherein the fractionator is a plurality of fractionators each set to a different fractionation temperature, a branch pipe having a branch portion branching from the downstream side of the reactor is connected to each of the plurality of fractionators, and the branch portion includes a switching valve that switches a pipe that communicates with the reactor in the branch pipe based on the detected concentration of the aromatic hydrocarbons.

4. An apparatus for producing a synthetic fuel, the apparatus comprising:

a reactor configured to contain an FT reaction catalyst exhibiting activity in a Fischer-Tropsch synthesis reaction (FT synthesis reaction) and produce an FT crude oil containing hydrocarbons from a raw material gas;

a fractionator provided on a downstream side of the reactor, configured to fractionate the FT crude oil, and separate hydrocarbons having a predetermined range of carbon numbers; and a reformer provided on a downstream side of the fractionator and configured to produce a fuel product from the hydrocarbons separated by the fractionator, wherein the apparatus further includes an aromatic detection unit that is provided between the reactor and the fractionator and detects a concentration of aromatic hydrocarbons contained in the FT crude oil, and a heat exchange type gas-liquid separation device provided between the reactor and the aromatic detection unit, and wherein a control unit of the apparatus is configured to change a fractionation temperature of the fractionator according to the detected concentration of the aromatic hydrocarbons.

5. The apparatus for producing a synthetic fuel according to claim 1, further comprising a notification unit configured to notify that a regeneration treatment or replacement of the FT reaction catalyst is required when the detected concentration of the aromatic hydrocarbons is below a predetermined threshold value.

6. A method for producing a synthetic fuel, the method comprising:

an FT crude oil production step of producing an FT crude oil containing hydrocarbons from a raw material gas using a reactor containing an FT reaction catalyst exhibiting activity in a Fischer-Tropsch synthesis reaction (FT synthesis reaction);

a fractionation step of fractionating the FT crude oil, and separating hydrocarbons having a predetermined range of carbon numbers by a fractionator provided on a downstream side of the reactor; and a reforming step of producing a fuel product from the separated hydrocarbons by a reformer provided on a downstream side of the fractionator, wherein the method further includes an aromatic detection step of detecting a concentration of aromatic hydrocarbons contained in the FT crude oil by an aromatic detection unit provided between the reactor and the fractionator, and wherein a fractionation temperature in the fractionation step is changed by a control unit of the apparatus to a temperature suitable for the FT synthesis reaction of hydrocarbons with a predetermined number of carbon atoms that is mainly to be obtained according to the detected concentration of the aromatic hydrocarbons.

* * * * *